US008920104B2

(12) United States Patent
Gilmore et al.

(10) Patent No.: US 8,920,104 B2
(45) Date of Patent: Dec. 30, 2014

(54) HYDRAULIC CROWD SYSTEM FOR ELECTRIC MINING SHOVEL

(75) Inventors: Carl D. Gilmore, South Milwaukee, WI (US); Robert Weber, Wadsworth, IL (US); Perry DeCuir, Rochester Hills, MI (US)

(73) Assignee: Caterpillar Global Mining LLC, South Milwaukee, WI (US)

( * ) Notice: Subject to any disclaimer, the term of this patent is extended or adjusted under 35 U.S.C. 154(b) by 529 days.

(21) Appl. No.: 13/321,421

(22) PCT Filed: Jun. 1, 2009

(86) PCT No.: PCT/US2009/045833

§ 371 (c)(1),
(2), (4) Date: Nov. 18, 2011

(87) PCT Pub. No.: WO2010/141007

PCT Pub. Date: Dec. 9, 2010

(65) Prior Publication Data

US 2012/0076628 A1 Mar. 29, 2012

(51) Int. Cl.
*E02F 3/30* (2006.01)
*E02F 9/22* (2006.01)

(52) U.S. Cl.
CPC ..... *E02F 3/304* (2013.01); *E02F 9/2267* (2013.01); *E02F 9/2271* (2013.01)
USPC ..... 414/690

(58) Field of Classification Search
CPC ..... E02F 3/30; E02F 3/304; E02F 3/306; E02F 3/308; E02F 3/42; E02F 3/425; E02F 3/427; E02F 3/46; E02F 3/52; E02F 9/2264; E02F 9/2267; E02F 9/2271; E02F 9/2278; E02F 9/2282; E02F 9/2289; E02F 9/2292
USPC ..... 37/394, 396, 902; 60/461; 414/687, 414/690, 691, 692, 693, 694, 695, 695.5
See application file for complete search history.

(56) References Cited

U.S. PATENT DOCUMENTS

| | | | | |
|---|---|---|---|---|
| 3,222,866 | A | 12/1965 | Lehman | |
| 3,375,943 | A | 4/1968 | Learmont et al. | |
| 3,425,574 | A | 2/1969 | Willgrubs et al. | |
| 2013/0318955 | A1 * | 12/2013 | ZHANG et al. | 60/413 |

FOREIGN PATENT DOCUMENTS

| | | |
|---|---|---|
| GB | 1 044 851 | 10/1966 |

OTHER PUBLICATIONS

International Search Report and Written Opinion for International Application No. PCT/US2009/045833, mail date Jan. 7, 2010, 12 pages.

* cited by examiner

*Primary Examiner* — Gregory Adams
*Assistant Examiner* — Brendan Tighe
(74) *Attorney, Agent, or Firm* — Foley & Lardner LLP

(57) ABSTRACT

A mining shovel (10) includes a hydraulic system comprising a plurality of fixed displacement pumps (104,106,108,110) driven by a variable speed motor (100), and a tank (68) system comprising an upper return tank and a lower supply tank (70). A cylinder manifold (64) is connected to the pump control manifold (112), and includes a directional control valve for directing the extend and retract functions of the cylinder (50), while accepting fluid flow in a single direction from the pump control manifold. The single direction flow allows for the use of smaller fluid conduits (61), such that the hose providing a high pressure supply can be comparatively smaller than the return hose (67).

20 Claims, 10 Drawing Sheets

HYDRAULIC CROWD SYSTEM FOR ELECTRIC MINING SHOVEL

CROSS-REFERENCE TO RELATED APPLICATIONS

The present application is a U.S. national stage of and claims priority to and the benefit of International Application No. PCT/US2009/045833, entitled "Hydraulic Crowd System for Electric Mining Shovel," filed Jun. 1, 2009, which is incorporated herein by reference in its entirety.

TECHNICAL FIELD

This invention relates to mining shovels, and more particularly to hydraulic crowd control mechanisms for a mining shovel.

DESCRIPTION OF THE BACKGROUND ART

A typical mining shovel includes a turntable mounted on a crawler truck, and supporting an A-frame and a cab. A boom extending from the turntable has an upper end supported by the A-frame. The boom pivotally supports a dipper handle which pivots in a vertical plane. A dipper fixed to a distal end of the dipper handle is raised and lowered by a hoist cable which extends over a sheave at the top of the boom and down to a padlock on the dipper. The hoist cable provides for the vertical, raising and lowering, movement of the dipper. A crowd mechanism extends and retracts the dipper handle to provide the horizontal component, or crowd, of the dipper's movement.

To provide the crowd mechanism for extending and retracting the dipper handle, many different types of crowd mechanisms have been developed. Prior art systems include rack and pinion crowd mechanisms and rope crowd mechanisms. Rack and pinion systems include a rack fixed to the dipper handle that engages a rotatably driven pinion, or gear, mounted in the boom. Rope crowd mechanisms include metal ropes that are wound and unwound from a crowd drum to extend and retract the dipper handle. While these types of crowd control mechanisms are advantageous in certain respects, they also suffer from certain disadvantages. For example, the rack teeth and ropes are prone to break when excessive force is applied Furthermore, the handles in rack and pinion mechanism which must remain rotatably fixed, and therefore cannot be rotated.

Hydraulic crowd mechanisms, such as the mechanism disclosed in U.S. Pat. No. 3,425,574, are also known. These hydraulic systems typically utilize a large double-acting hydraulic actuator for extending and retracting the dipper handle. Hydraulic crowd mechanisms provide certain advantages over other types of systems because the hydraulic systems can use round tubular handles that are free to rotate. Further, they do not include rack teeth or ropes, which are prone to break when excessive force is applied While hydraulic mechanisms therefore provide certain advantages over other types of crowd controls, particularly with respect to maintenance, the volume of hydraulic fluid necessary to control the crowd of a mining shovel dipper handle requires complex large hoses, designed to carry a large volume of fluid, and at high pressures. Because of the high pressure application, these hoses are subject to significant wear, and requiring a significant degree of maintenance. Accordingly, a need exists for a hydraulic crowd mechanism which responds quickly to operator inputs, and which operates without a significant degree of maintenance.

SUMMARY OF THE INVENTION

In one aspect, the present invention provides a mining shovel comprising a crawler truck, a turntable, an A frame, and a hydraulic control unit coupled to the crawler truck. A boom extends form the turntable, having an upper end supported by the A-frame. A sheave is coupled to a distal upper end of the boom. A dipper handle including a dipper at a distal end is pivotally supported by the boom, to pivot the dipper in a vertical plane. A hoist cable is provided over the sheave at the top of the boom and connected to the dipper, for vertically raising and lowering the dipper. A crowd mechanism including a double acting hydraulic cylinder for extending and retracting the dipper handle horizontally is coupled to the boom. A hydraulic power unit is mounted to the turntable and includes a pump and a return tank with separate supply tank for hydraulic fluid. A cylinder control manifold is coupled to the double acting hydraulic cylinder in fluid communications with the pump and the return tank, the cylinder control manifold driving the double acting hydraulic cylinder to extend and retract the crowd mechanism, wherein the crowd pump manifold directs fluid flow in a single direction from the pump to the return tank wherein a supply conduit for providing a high pressure supply to the cylinder actuator is smaller than a return conduit providing a low pressure path to the return tank.

In another aspect of the invention, the cylinder manifold comprises a valve for regenerating hydraulic fluid from a rod end of the hydraulic cylinder during an extend operation for driving the double acting hydraulic cylinder horizontally away from the boom. The manifold comprises a valve for directing fluid from a cap end of the hydraulic cylinder to the return tank during a retract operation for driving the double acting hydraulic cylinder horizontally toward the boom.

In another aspect of the invention, the supply conduit is sized to provide a supply of high pressure fluid half of the size of the return conduit. In one particular embodiment, the supply conduit is sized to provide a supply of 500 gallons per minute, and the return conduit is sized to receive a return of 1000 gallons per minute.

In another aspect of the invention, the cylinder manifold comprises a cap end valve, a rod end valve, and a regenerate valve, and wherein the regenerate valve provides fluid flow to the cap end during an extend operation and to the return tank during a retract operation.

In still another aspect of the invention the pump is a fixed displacement pump driven by a variable speed motor. The pump can be one of a plurality of fixed displacement pumps, each of the plurality of fixed displacement pumps being connected to a pump manifold for combining the output of the pumps, and wherein the output of the pump manifold is directed to the cylinder control manifold.

In yet another aspect of the invention, a supply tank can be coupled to the pump, and the return tank can be elevated above the supply tank.

These and still other advantages of the invention will be apparent from the description which follows. In the detailed description below, the preferred embodiment of the invention will be described in reference to the accompanying drawings. This embodiment does not represent the full scope of the invention. Rather the invention may be employed in other embodiments. Reference should therefore be made to the claims herein for interpreting the breadth of the invention.

DETAILED DESCRIPTION OF THE PREFERRED EMBODIMENTS

Figure 1:
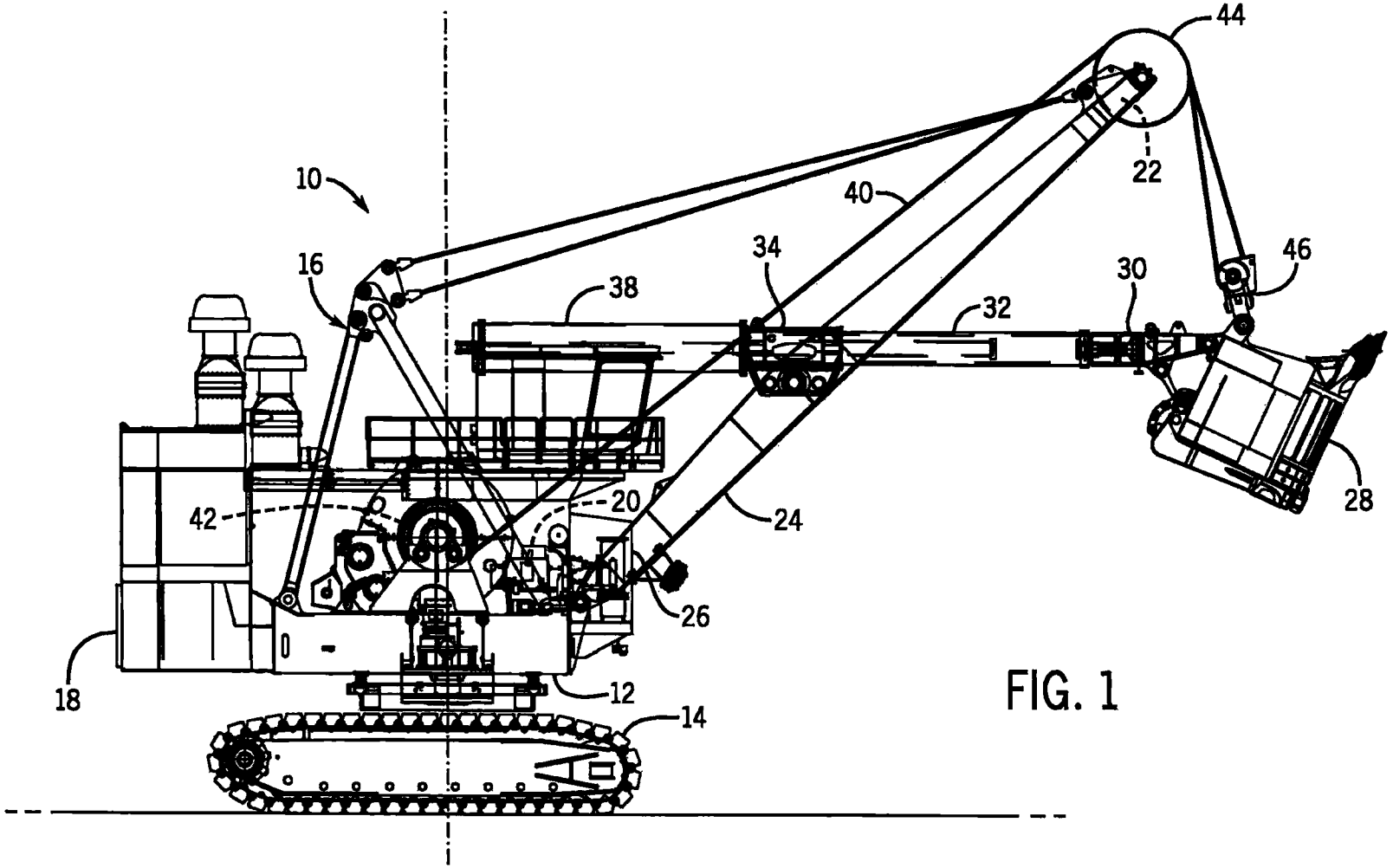
FIG. 1 is a perspective view of a mining shovel.
Figure 2:
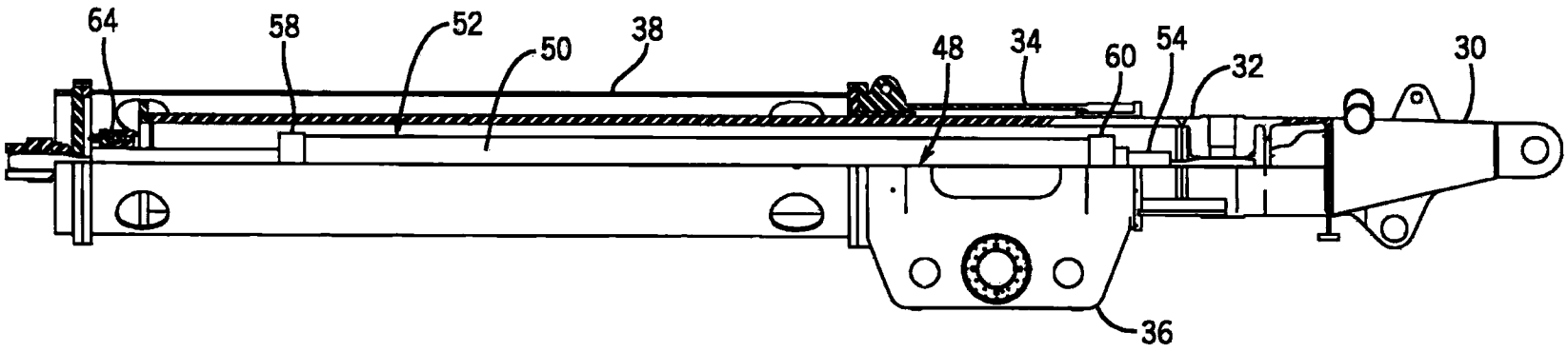
FIG. 2 is a side view elevation, partially in section, of the dipper handle and saddle block of the power shovel of FIG. 1.
Figure 3:
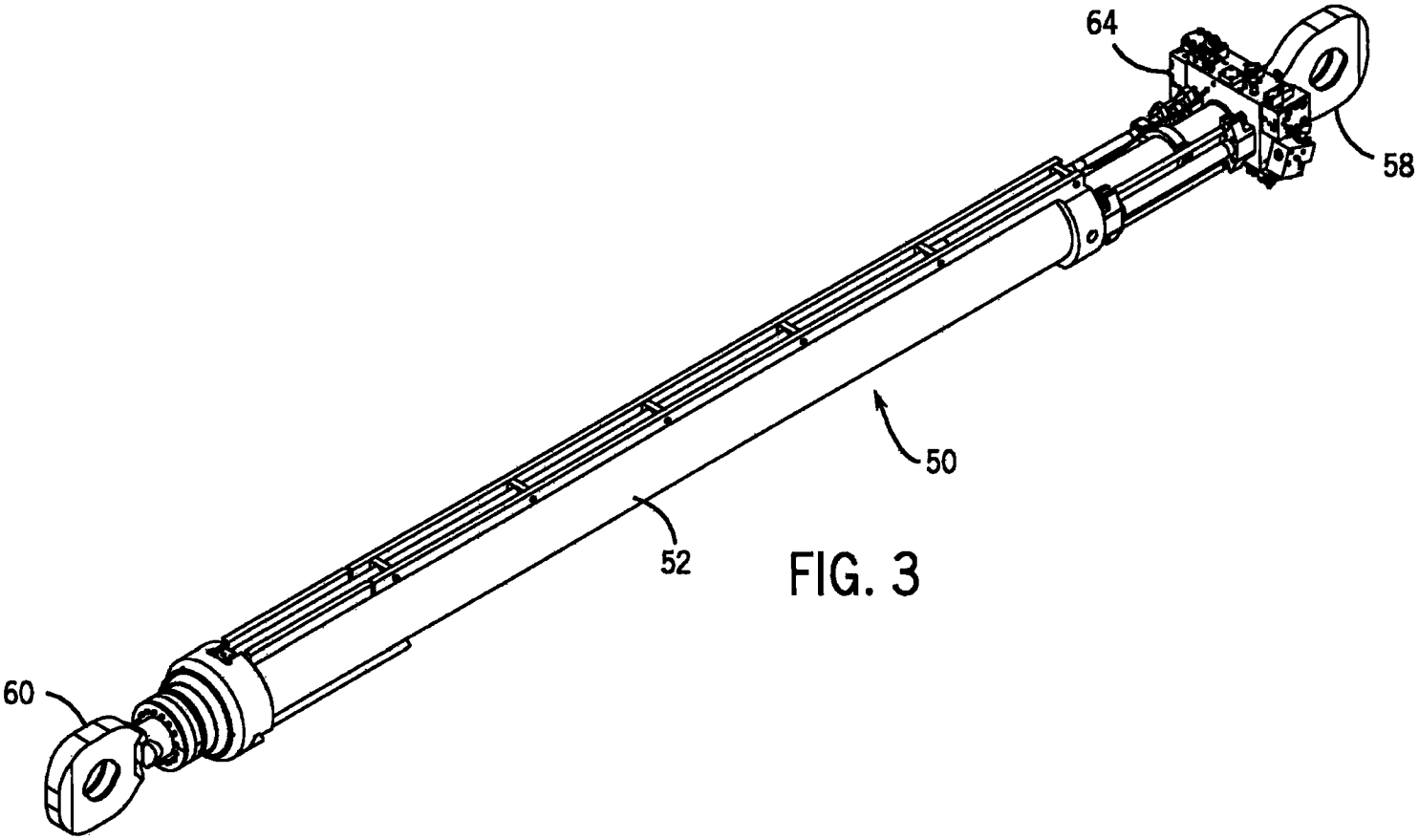
FIG. 3 is a perspective view of the hydraulic actuator of FIG. 2.
Figure 4:
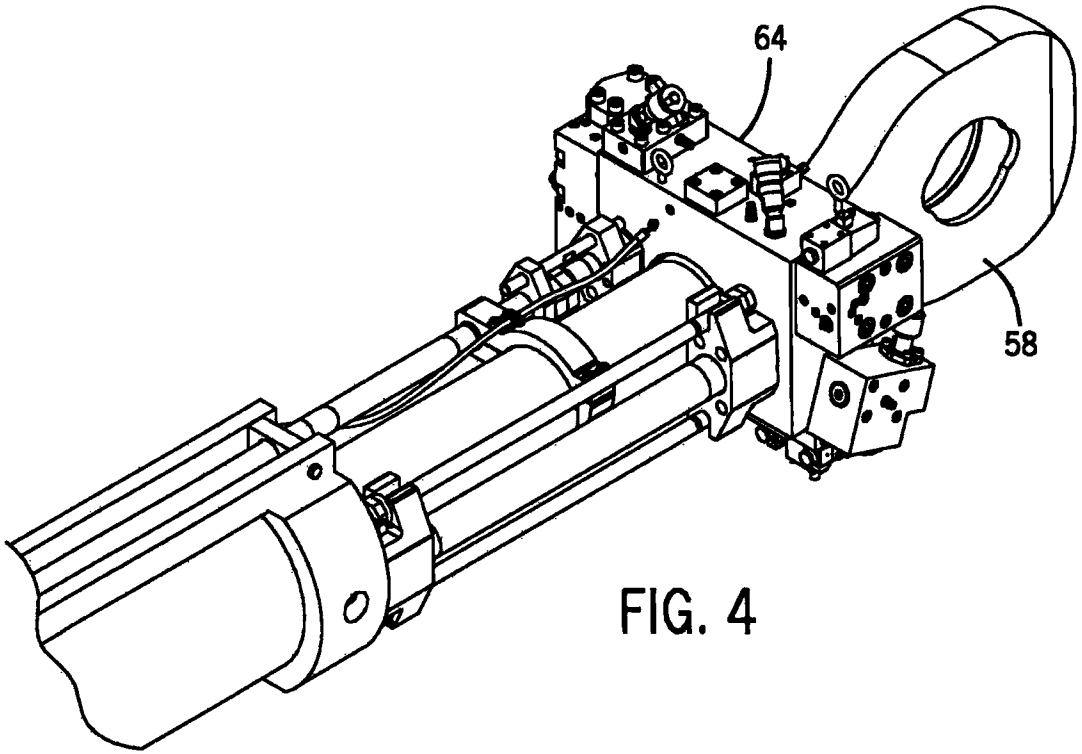
FIG. 4 is a perspective view of a cylinder control manifold coupled to the hydraulic actuator.

Referring to FIG. 1, a mining shovel 10 is shown. The mining shovel 10 includes a turntable 12 mounted on a crawler truck 14, and supporting an A-frame 16 and a cab 18. The cab houses a power unit 20, including a hydraulic crowd control system 21 (FIG. 2), and an electrical control system that operates the mining shovel components in response to inputs from the operator and automatic devices, such as limit switches, pressure switches, temperature switches, and the like. The operator can provide inputs from within the cab through manually operable devices, such as a joystick, lever, foot pedals, rocker switches, computer keyboard, touch pads, and the like.

The A-frame 16 supports a top end 22 of a boom 24, a bottom end 26 of the boom 24 being supported by the turntable 12. A dipper 28 is mounted on the front end 30 of a dipper handle 32 which is slidably supported in a saddle block 34 mounted in the boom 24. The saddle block includes a yoke 36 and a support frame 38 which projects rearwardly from the yoke 36 and encloses the back end of the dipper handle 32. The yoke 36 of the saddle block 34 is pivotally mounted in the boom 24, so as to pivot in a vertical plane. A hoist cable 40 extends upward from a powered hoist drum 42 on the turntable 12, over a sheave 44 at the top end 22 of the boom 24 and down to a padlock 46 on the dipper 28. The hoist cable 40 provides for the vertical, raising and lowering, movement of the dipper 28. A hydraulic crowd mechanism 48 (FIG. 2) enclosed in the support frame 38, provides the horizontal component, or crowd, of the dipper's movement.

Referring now to FIGS. 2-5, the hydraulic crowd control mechanism 48 includes a double acting hydraulic actuator 50 having a cylinder 52, a cap end 58, and a rod end 60 including an extendible ram 54. A cylinder manifold 64, which includes control valves for providing bidirectional control of the cylinder, and load holding functions, is mounted at the cap end 58 of the hydraulic actuator 50. The cylinder manifold 64, described more fully below, is integrally mounted to the cap end 58, along with steel tube connecting lines from manifold 64 to the hydraulic actuator 50 ports. The integral connection of the cylinder manifold 64 to the hydraulic actuator 50 and the use of steel tube connections from the cylinder manifold 64 to the hydraulic actuator 50 eliminate the need for flexible connecting hoses, thus eliminating the possibility of hose failure between the cylinder manifold 64 and the hydraulic actuator 50.

In the embodiment disclosed herein, the cap end 58 and the cylinder 52 are fixed relative to the saddle block 34, and the ram 54 is fixed relative to the dipper handle 32. As a result, extension of the ram 54 from a retracted position in the hydraulic actuator 50 toward an extended position urges the dipper handle 32 from a retracted position to an extended position. Conversely, retraction of the ram 54 into the hydraulic actuator 50 from the extended position toward the retracted position urges the dipper handle 32 from the extended position toward the retracted position. Of course, the hydraulic actuator 50 can be fixed relative to the dipper handle 32, and the ram 54 can be fixed relative to the saddle block 34 without departing from the scope of the invention.

Figure 5:
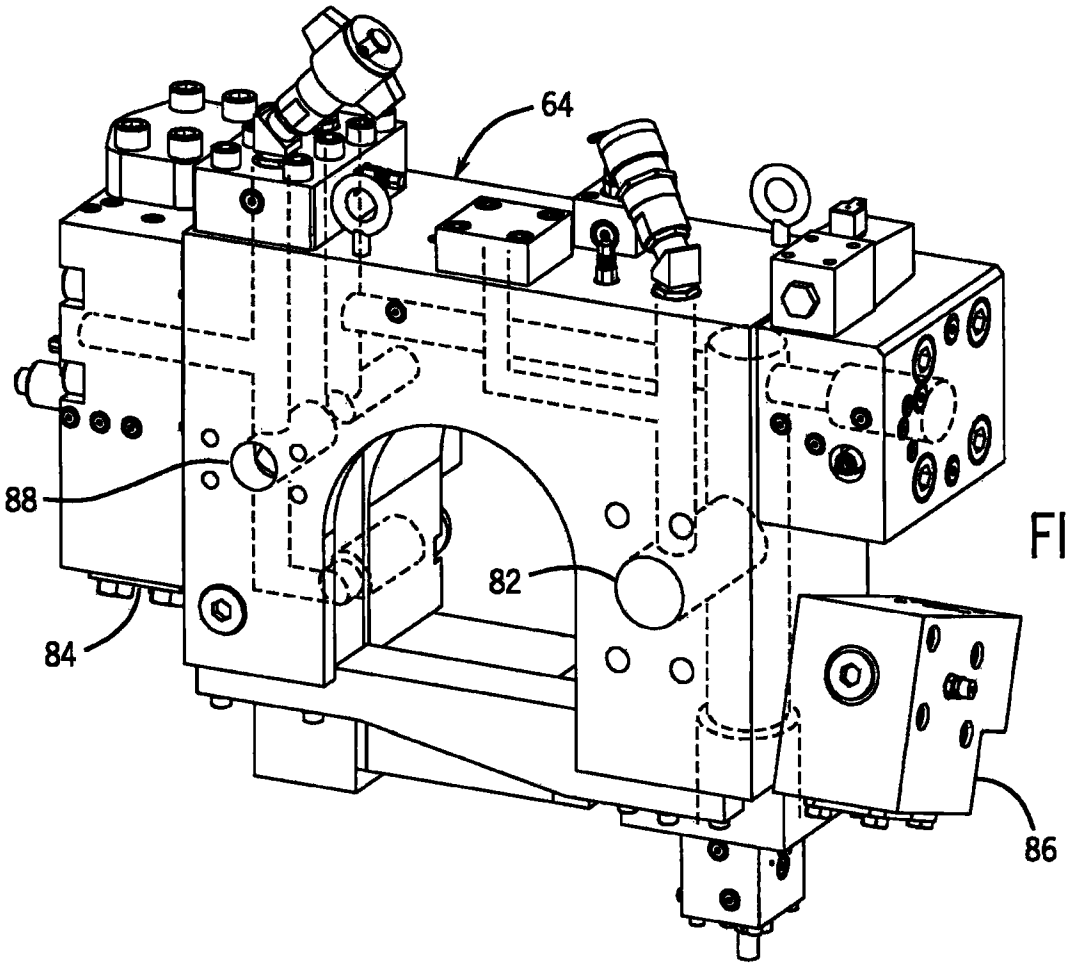
FIG. 5 is a perspective view of the cylinder control manifold, illustrating input and output ports.
Figure 6:
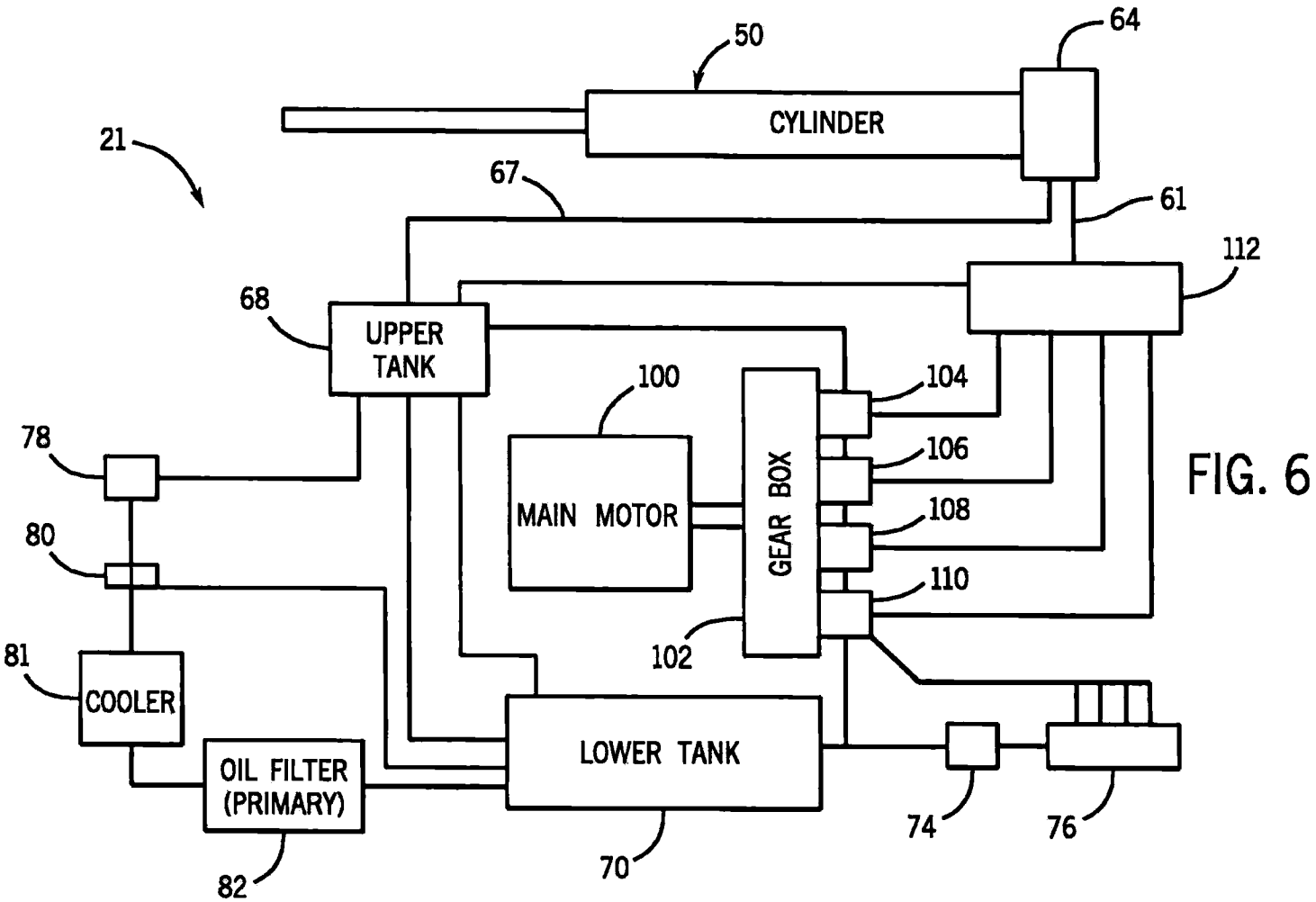
FIG. 6 is a block diagram of the hydraulic system including the tank system of the present invention.

Referring now to FIGS. 5 and 6, a perspective view of the cylinder control manifold 64 and a block diagram of the hydraulic control system 21 of the mining shovel 10 are shown, respectively. The hydraulic control system 21 includes a variable speed motor 100 that drives a gear box 102 which is coupled to four fixed displacement pumps, 104, 106, 108, and 110. The output of the pumps 104, 106, 108, and 110 is directed to a pump control manifold 112, which combines the flow from the pumps 104, 106, 108, and 110, and directs the flow through high pressure supply lines 61 to an input port 84 on the cylinder control manifold 64. The fixed displacement pumps 104, 106, 108, and 110 and variable speed motor 100 provide a variable output flow power.

Referring still to FIGS. 5 and 6, and now specifically to FIG. 5, the cylinder control manifold 64 is coupled to and drives the hydraulic actuator 50 in the hydraulic crowd control mechanism 48, providing directional control of the actuator 50. Hydraulic fluid is directed into the cylinder manifold inlet port 84, is provided to a rod end port 88 for controlling the rod end 60, and to a cap end port 82 for controlling cap end 58. Hydraulic fluid returned from the hydraulic actuator 50 is directed from a port 86 on the cylinder manifold 64, through low pressure plumbing lines 67 to a hydraulic tank system that includes an upper tank 68 connected to a lower tank 70. As can be seen in FIG. 5, the inlet port 84, rod end port 88 and corresponding conduits in the cylinder control manifold 64 are sized comparatively smaller than the cap end port 82, outlet port 86 and corresponding conduits. As described more fully below, because of the directional control provided by the cylinder manifold 64, the high pressure supply line 61 requires a smaller capacity than the low pressure return lines 67, and the conduits in the cylinder manifold 64 are sized accordingly. Although other pressure levels are possible, in one embodiment, the high pressure supply lines 61 deliver 500 gallons per minute for both extend and retract. The low pressure return lines 67 have a 1000 gallons per minute return to tank during retract.

Referring still to FIGS. 5 and 6, the system further includes a flushing pump 74 and associated flushing manifold 76, and a circulation pump 78 and associated circulation manifold 80. A cooler 81 is also provided for maintaining the temperature of the hydraulic fluid or oil, as well as a primary oil filter 82 for filtering the oil. In one embodiment of the invention, for example, the cooler can be provided to control the temperature of oil between the upper tank 68 and the lower tank 70.

Figure 7:
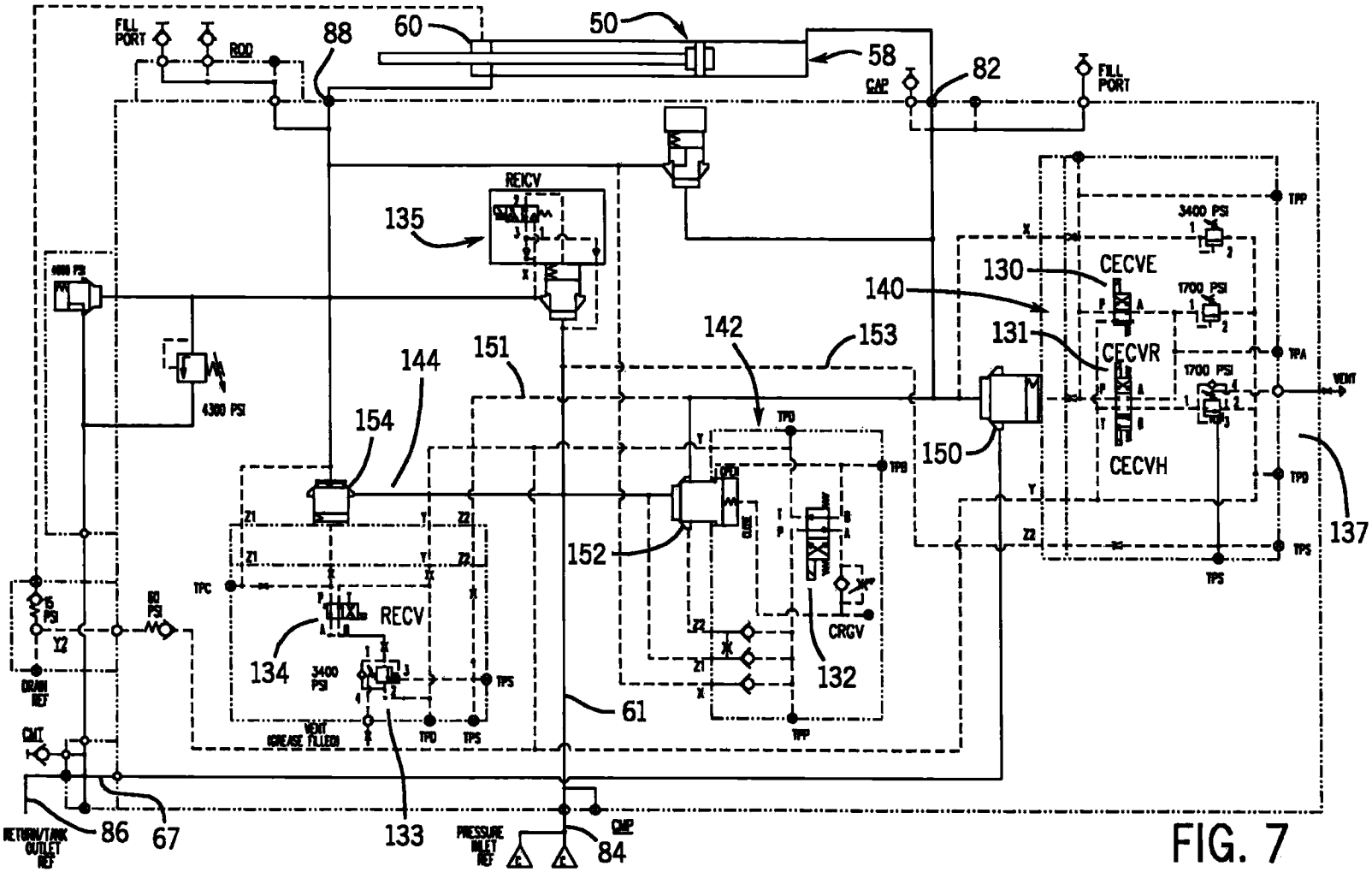
FIG. 7 is a schematic diagram of the hydraulic circuit in the cylinder control manifold of FIG. 5.

Referring now to FIG. 7, a schematic diagram illustrating the operation of the cylinder manifold 64 is shown. The cylinder manifold 64 comprises a connector 86 for connecting the cylinder manifold 64 to the upper tank 68, and a connector 84 for connecting the cylinder manifold 64 to high pressure fluid input from the pump control manifold 112. The circuit includes a number of pilot-operated poppet valves, including a cap end pilot-operated counterbalance poppet valve 140, a crowd regeneration pilot-operated poppet valve 142, and a rod end pilot-operated counterbalance poppet valve 144. Each of these valves includes a poppet valve 150, 152, and 154, respectively, that is controlled by one or more solenoid operated spool valves directly or in series combination with counterbalance valves. Specifically, the cap end pilot-operated poppet valve 140 includes a cap end extend spool and counterbalance valve 130, and a cap end retract spool and counterbalance valve 131, the rod end pilot-operated poppet valve 144 includes a rod end spool and counterbalance valve 134, and the crowd regeneration valve 142 includes a crowd regeneration spool valve 132. A rod end inlet check valve 135 is on during operational modes, and off when the shovel 10 is deactivated, preventing backflow when the shovel 10 is off. In operation, the crowd regeneration pilot-operated poppet valve 142, located at the cylinder control manifold 64, provides a directional function control for cylinder extend or retract directions. With cylinder directional control provided at the cylinder manifold 64, this allows for fluid flow in a single direction from the pump manifold 112 to the cylinder manifold 64, allowing for smaller hose sizing, as described below.

To extend the crowd control mechanism 48, the rod end counterbalance valve 134, and the crowd regeneration counterbalance valve 132 are energized, allowing fluid to flow from the pump manifold 112, through the crowd regeneration pilot-operated poppet valve 152, and to the cap end 58. As the hydraulic actuator 50 extends, oil flows from the rod end 60 toward the rod end pilot-operated counterbalance poppet valve 144. Pilot pressure travels along conduit 151 to the rod end counterbalance valve 144 and signals the corresponding counterbalance cartridge 133 to open. As the cartridge 133 opens, the oil from the top of the rod end poppet valve 154 is allowed to vent through the counterbalance cartridge 133 which allows the poppet in the poppet valve 154 to open. Oil then flows through the poppet valve 154 and joins the fluid flow from the pump manifold 112 to the crowd regeneration pilot-operated poppet valve 142 and into the cap end 58 of the hydraulic actuator 50. During the extend action, no oil is directed to the outlet 86 to the tank 68.

To retract the crowd control mechanism 48, the cap end retract counterbalance valve 131 solenoid is energized, and pressure from the pump manifold 112 opens the inlet poppet valve 135 allowing oil to flow to rod end 60 of the cylinder. As the hydraulic actuator 50 retracts, oil flows from the cap end 58 of the hydraulic actuator 50 and towards the cap end poppet valve 150. Pilot flow along conduit 153 signals the counterbalance cartridge 137 to open. As the cartridge 137 opens, the oil from the top of the cap end poppet valve 150 is allowed to vent through the counterbalance cartridge 137, which allows the poppet to open. Oil from the cap end 58 of the hydraulic actuator 50 flows through the cap end poppet valve 150 and back to the upper tank 68. Again, the counterbalance valves provide meter out control of the load.

To provide a hold function, all of the valve solenoids are de-energized, and the rod end counterbalance valve 132 is closed. Pressure at rod end 60 is allowed on top of all three poppet valves 150, 152, and 154, which holds them closed and prevents the hydraulic actuator 50 from extending.

During operation, therefore, oil is drawn from the pump manifold 112 and into the corresponding inlet 84 in the cylinder control manifold 64 during both the extend and retract operations. During the extend operation, the crowd regeneration pilot-operated poppet valve 144 regenerates oil and directs the oil to the cap end 58 of the cylinder. No oil returns to tank through the outlet 86. During the retract operation, oil continues to be drawn from the pump manifold 112, and is directed from the cap end pilot-operated poppet valve 140 and to tank. The regenerative flow path provided by the crowd regenerate pilot-operated poppet valve 140 assures that the extend speed of the cylinder is equal to the retract speed, and that push and pull forces are equal to each other, with a 2:1 cylinder to rod ratio.

Figure 8:
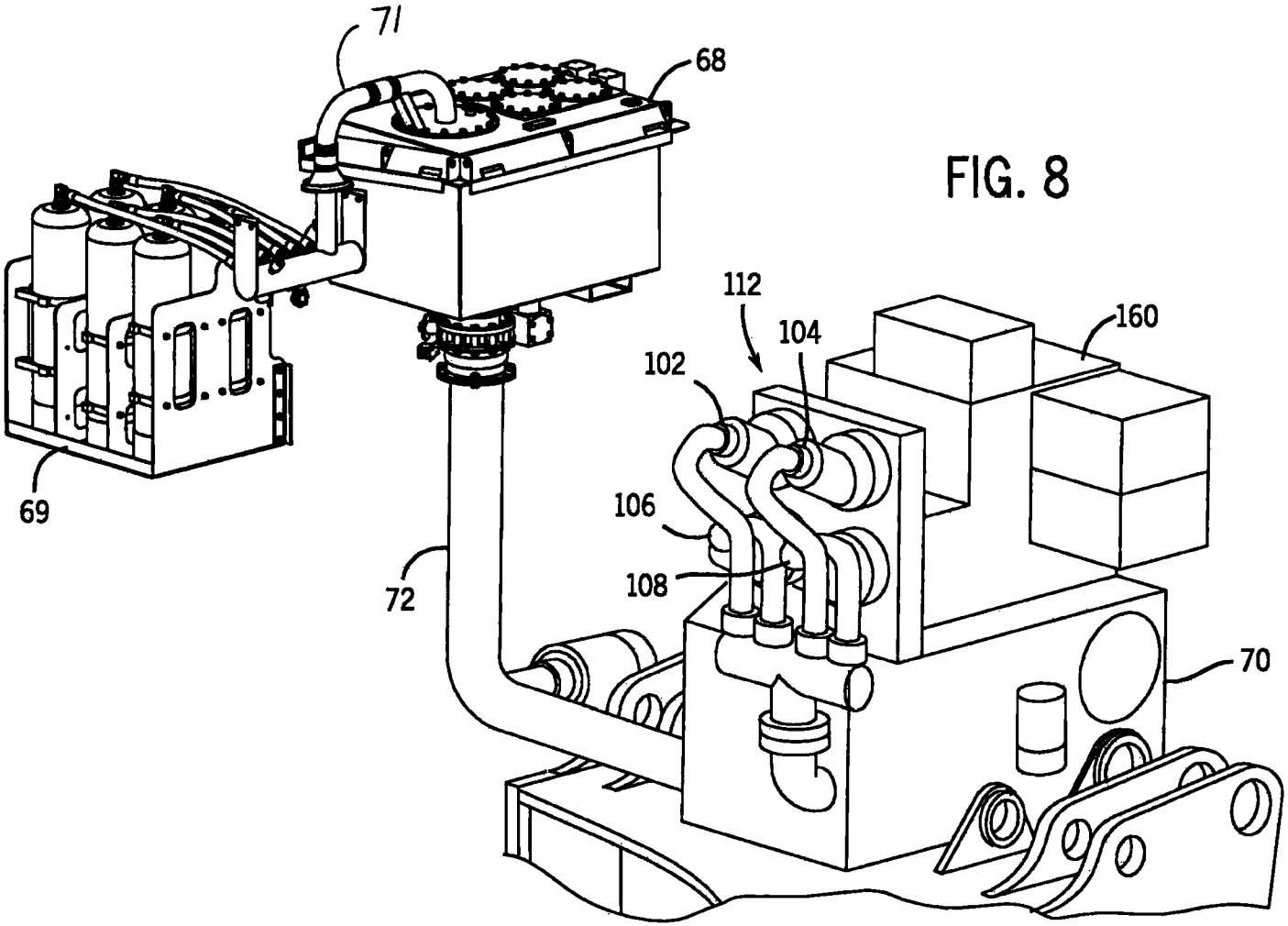
FIG. 8 is a partial perspective view of the tank system of the present invention.

Referring now to FIG. 8, a perspective view of the tank system of the present invention is shown. As described above, the hydraulic tank system includes both an upper tank 68 and a lower tank 70. The upper tank 68 supplies oil to the lower tank 70 through a transfer pipe 72. Because of the force of gravity from the upper tank 68, a positive head pressure is supplied at the pump inlets, and prevents cavitation to the pumps. In one embodiment of the invention, the tank can be a sealed tank system. Here, a bank of expansion bladders 69, is coupled to the upper tank 68 through an air transfer tube 71. The expansion bladders 69 allow for the differential volume of oil in the reservoir and exchange of air into and out of the reservoir and bladder. Each of the bladders in the bank of expansion bladders 69 expands and contracts as air is exchanged, and is sufficiently flexible so as to not pressurize the tank system above the atmospheric pressure.

Figure 9:
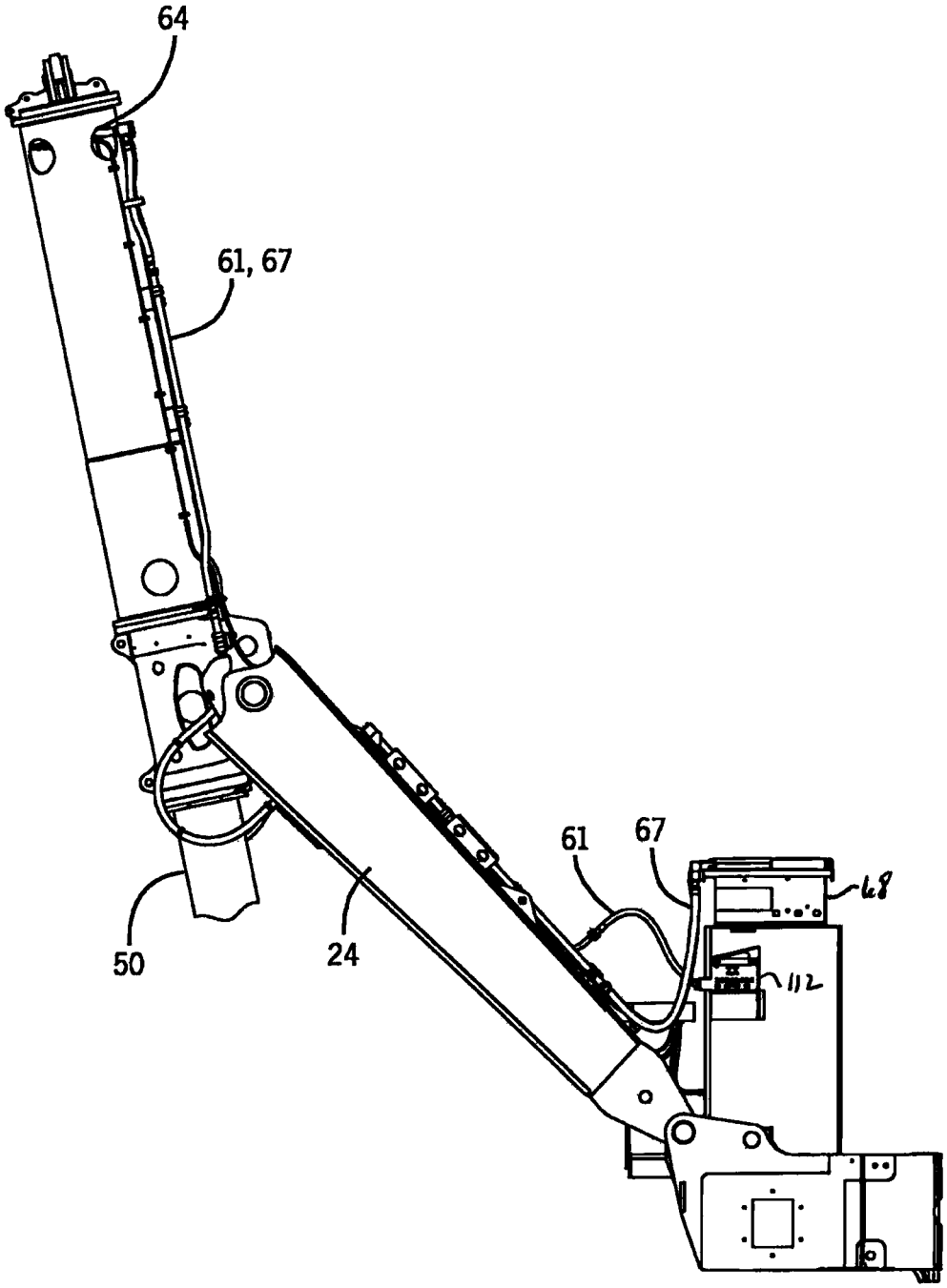
FIG. 9 is a side view of the lower portion of the boom of the mining shovel and connection to the crowd mechanism, illustrating the hoses and tubes providing the hydraulic fluid flow from the revolving frame, along the boom and crowd mechanism.
Figure 10:
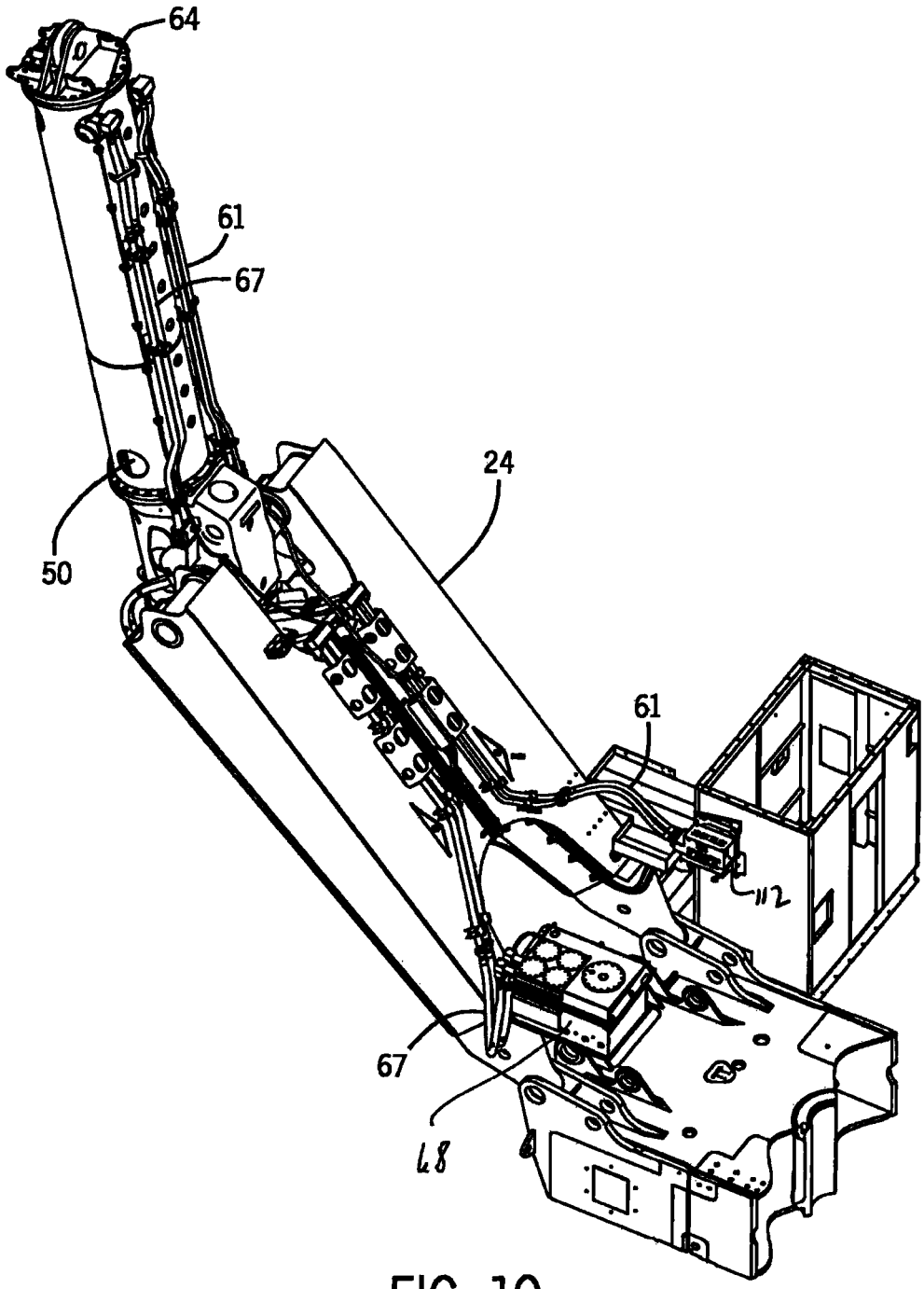
FIG. 10 is a perspective view of FIG. 9, illustrating the connections of the hydraulic flow lines to the pump manifold and return tank.

Referring now to FIGS. 9 and 10, illustrations of the hydraulic control lines as they extend from the hydraulic power unit 20 in the cab 18, up the boom 24, and onto the crowd mechanism 48 are shown. Because of the single direction flow provided by the cylinder control manifold 64, the directional flow of oil through the boom 24 is also in a single direction. High pressure oil is directed in a first direction along the tubes and hoses 61, which direct oil to the cylinder control manifold 64, as described above. Large diameter dual tubes and low pressure hoses 67 carry return oil from the cylinder control manifold 64 to the return tank 68. The inlet hoses and conduits from the pump manifold 112 therefore can be sized significantly smaller than the outlet hoses and conduits. As described above, in one embodiment of the invention, the high pressure supply side plumbing 61 delivers 500 gallons per minute for both extend and retract. Because of the regenerative connection in the cylinder manifold described above, there is no output in the low pressure hoses 61 during extend, and 1000 gallons per minute during retract, when oil is returned to tank 68. Here, the supply lines 61 extending along the boom 24 in a pair of tubes, each of which is 50 millimeters in diameter. The return lines 67 are sized to carry the larger, low pressure return to tank, and can comprise two 75 millimeter tubes.

A number of advantages, therefore, are provided by the present invention. The fixed displacement pumps with variable speed motor provide a simple variable output flow power unit, while avoiding the complexity and maintenance issues associated with variable displacement pumps and load sense servo controls for variable displacement. Further, when there is no speed demand, there is no power consumption, because the main drive motor and pumps are not turning.

The single direction flow path for the supply and return of plumbing provided by the directional control of the cylinder manifold 64, as discussed above, allows large diameter low pressure return hoses, and small diameter high pressure hoses, allowing commercially available high pressure hoses to be used. In the larger diameter return hose, flow velocity can be kept at a reasonably low magnitude, thereby improving the lifetime of the hose. The cylinder manifold 64 also provides meter out control for over-running loads, and a fail safe lock up and position holding of the cylinder.

Additionally, the dual tank system including a return tank in an elevated position provide a positive head pressure of oil to supply the pumps, which insures long pump service life by minimizing potential for cavitation at the input pumps.

Although specific embodiments have been shown and described, it will be apparent that a number of variations could be made within the scope of the invention. It should be understood therefore that the methods and apparatuses described above are only exemplary and do not limit the scope of the invention, and that various modifications could be made by those skilled in the art that would fall under the scope of the invention. To apprise the public of the scope of this invention, the following claims are made:

We claim:

1. A mining shovel comprising:

a crawler truck;

a turntable mounted to the crawler truck;

an A-frame mounted to the turntable;

a hydraulic power unit mounted to the turntable and including a pump and a return tank for hydraulic fluid;

a boom extending from the turntable and having an upper end supported by the A-frame, and including a sheave coupled to a distal upper end of the boom;

a dipper handle including a dipper at a distal end pivotally supported by the boom, to pivot the dipper in a vertical plane;

a hoist cable extends over the sheave at the top of the boom and to the dipper, for vertically raising and lowering the dipper; and a crowd mechanism including a double acting hydraulic cylinder for extending and retracting the dipper handle horizontally, wherein a cylinder control manifold is coupled to the double acting hydraulic cylinder in fluid communications with the pump and the return tank, the cylinder control manifold driving the double acting hydraulic cylinder to extend and retract the crowd mechanism, wherein the cylinder control manifold directs fluid flow in a single direction from the pump to the return tank such that fluid flows in a single direction through a supply conduit for providing a supply from the pump to the cylinder actuator and through a return conduit for providing a path to the return tank, wherein the supply conduit has a smaller diameter than the return conduit such that the single direction fluid flow has a higher pressure when entering the cylinder actuator than when returning to the return tank.

2. The mining shovel as recited in claim 1, wherein the cylinder control manifold comprises a valve for regenerating hydraulic fluid from a rod end of the hydraulic cylinder during an extend operation for driving the double acting hydraulic cylinder horizontally away from the boom.

3. The mining shovel as recited in claim 1, wherein the cylinder control manifold comprises a valve for directing fluid from a cap end of the hydraulic cylinder to the return tank during a retract operation for driving the double acting hydraulic cylinder horizontally toward the boom.

4. The mining shovel as recited in claim 1, wherein the supply conduit is sized to provide a supply of high pressure fluid half of the size of the return conduit.

5. The mining shovel as recited in claim 1, wherein the supply conduit is sized to provide a supply of 500 gallons per minute, and the return conduit is sized to receive a return of 1000 gallons per minute.

6. The mining shovel as recited in claim 1, wherein the cylinder manifold comprises a cap end valve, a rod end valve, and a regenerate valve, and wherein the regenerate valve provides fluid flow to the cap end during an extend operation and to the return tank during a retract operation.

7. The mining shovel as recited in claim 1, wherein the pump is a fixed displacement pump driven by a variable speed motor.

8. The mining shovel as recited in claim 1, wherein the pump is one of a plurality of fixed displacement pumps, each of the plurality of fixed displacement pumps being connected to a pump manifold for combining the output of the pumps, and wherein the output of the pump manifold is directed to the cylinder control manifold.

9. The mining shovel as recited in claim 1, further comprising a supply tank coupled to the pump, wherein the return tank is in fluid communication with the supply tank, and the return tank is elevated above the supply tank.

10. A mining shovel comprising:

a crawler truck;

a turntable mounted to the crawler truck;

an A-frame mounted to the turntable;

a hydraulic power unit mounted to the turntable and including a variable speed motor driving a plurality of fixed displacement pumps, the pumps drawing oil from a lower tank, and an upper return tank;

a boom extending from the turntable and having an upper end supported by the A-frame, and including a sheave coupled to a distal upper end of the boom;

a dipper handle including a dipper at a distal end pivotally supported by the boom, to pivot the dipper in a vertical plane;

a hoist cable extends over the sheave at the top of the boom and to the dipper, for vertically raising and lowering the dipper; and a crowd mechanism including a double acting hydraulic cylinder for extending and retracting the dipper handle horizontally, wherein a cylinder control manifold is coupled to the double acting hydraulic cylinder in fluid communications with the plurality of fixed displacement pumps and to the return tank, the cylinder control manifold driving the double acting hydraulic cylinder to extend and retract the crowd mechanism, wherein the cylinder control manifold directs fluid flow in a single direction from the fixed displacement pumps to the return tank such that fluid flows in a single direction through a supply conduit for providing a supply from the fixed displacement pumps to the cylinder actuator and through a return conduit for providing a path to the return tank, wherein the supply conduit has a smaller diameter than the return conduit such that the single direction fluid flow has a higher pressure when entering the cylinder actuator than when returning to the return tank.

11. The mining shovel as recited in claim 10, wherein the cylinder control manifold comprises a valve for regenerating hydraulic fluid from a rod end of the double acting hydraulic cylinder during an extend operation for driving the double acting hydraulic cylinder horizontally away from the boom.

12. The mining shovel as recited in claim 10, wherein the cylinder control manifold comprises a valve for directing fluid from a cap end of the double acting hydraulic cylinder to the return tank during a retract operation for driving the double acting hydraulic cylinder horizontally toward the boom.

13. The mining shovel as recited in claim 10, wherein the supply conduit is sized to provide a supply of high pressure fluid half of the size of the return conduit.

14. The mining shovel as recited in claim 10, wherein the supply conduit is sized to provide a supply of 500 gallons per minute, and the return conduit is sized to receive a return of 1000 gallons per minute.

15. The mining shovel as recited in claim 10, wherein the cylinder control manifold comprises a cap end valve, a rod end valve, and a regenerate valve, and wherein the regenerate valve provides fluid flow to the cap end valve during an extend operation and to the return tank during a retract operation.

16. The mining shovel as recited in claim 10, wherein the plurality of fixed displacement pumps are connected to a pump manifold for combining the output of the fixed displacement pumps, and wherein the output of the pump manifold is directed to the cylinder control manifold.

17. The mining shovel as recited in claim 10, further comprising a supply tank coupled to the fixed displacement pumps, wherein the return tank is in fluid communication with the supply tank, and the return tank is elevated above the supply tank.

18. A hydraulic control system for a mining shovel, the system comprising:

a cylinder control manifold configured to couple to a double acting hydraulic cylinder such that the cylinder control manifold is in fluid communication with a fixed displacement pump and a return tank, wherein the cylinder control manifold is configured to drive the double acting hydraulic cylinder to extend and retract a crowd mechanism of the mining shovel;

a supply conduit coupled to the cylinder control manifold and configured to provide a supply from the fixed displacement pump to the double acting hydraulic cylinder; and a return conduit coupled to the cylinder control manifold and configured to provide a path to the return tank;

wherein the cylinder control manifold is configured to direct fluid flow in a single direction from the fixed displacement pump to the return tank such that fluid flows in a single direction through the supply conduit and the return conduit, and wherein the supply conduit has a smaller diameter than the return conduit such that the single direction fluid flow has a higher pressure when entering the cylinder actuator than when returning to the return tank.

19. The hydraulic control system of claim 18, wherein the cylinder control manifold further comprises:

an inlet port coupled to the supply conduit and configured to receive the supply from the supply conduit, wherein the inlet port is sized according to a diameter of the supply conduit; and an outlet port coupled to the return conduit and configured to route the single direction fluid flow to the return conduit, wherein the outlet port is sized according to a diameter of the return conduit.

20. The hydraulic control system of claim 19, wherein the inlet port is sized comparatively smaller than the outlet port, including having a smaller diameter than the outlet port.

* * * * *